US012262768B1

(12) United States Patent
Alexander-Pubill

(10) Patent No.: US 12,262,768 B1
(45) Date of Patent: Apr. 1, 2025

(54) MULTI-COLOR WAISTBELT

(71) Applicant: John C. Alexander-Pubill, McKinney, TX (US)

(72) Inventor: John C. Alexander-Pubill, McKinney, TX (US)

( * ) Notice: Subject to any disclaimer, the term of this patent is extended or adjusted under 35 U.S.C. 154(b) by 0 days.

(21) Appl. No.: 18/137,317

(22) Filed: Apr. 20, 2023

(51) Int. Cl.
*A41F 9/02* (2006.01)
*A41F 9/00* (2006.01)

(52) U.S. Cl.
CPC ..... *A41F 9/025* (2013.01); *A41F 9/00* (2013.01); *A41F 9/002* (2013.01); *A41F 9/02* (2013.01)

(58) Field of Classification Search
CPC .. A41F 9/025; A41F 9/00; A41F 9/002; A41F 9/02; C14B 5/04
See application file for complete search history.

(56) References Cited

U.S. PATENT DOCUMENTS 670,726 A * 3/1901 Pierce ..... A41F 9/002 2/322
1,210,083 A * 12/1916 Knower ..... A41F 9/002 2/338
1,705,790 A * 3/1929 Tallman ..... A41F 9/002 69/21
1,799,868 A * 4/1931 Sauer, Jr. ..... A44C 5/0053 224/178
2,396,329 A * 3/1946 Lippmann ..... A41F 9/002 2/338
3,026,533 A * 3/1962 Zakarin ..... A41F 9/002 2/322
3,369,278 A * 2/1968 Humphreys ..... A44B 11/008 2/322
3,636,569 A * 1/1972 Nielson ..... A44B 13/0076 2/325
3,848,271 A * 11/1974 Goele ..... A41F 9/002 2/338
3,855,637 A * 12/1974 Luger ..... A44B 11/006 2/301
3,913,147 A * 10/1975 Ostrander ..... A44B 11/22 2/325

(Continued)

OTHER PUBLICATIONS

Reversible Leather Belt With Easy Fix Buckle. Product Listing [online]. Copyright © 2023 Alaindelon.co.uk retrieved on Apr. 18, 2023]. Retrieved from the Internet <URL: https://www.alaindelon.co.uk/reversible-leather-belt-with-easy-fix-buckle-p12272>.

(Continued)

*Primary Examiner* — Khaled Annis
(74) *Attorney, Agent, or Firm* — Cramer Patent & Design, PLLC.; Aaron R. Cramer

(57) ABSTRACT

The four color waistbelt may comprise a strap, a buckle, and a twist coupling. The four color waistbelt may be a belt that may be reconfigured to display any one of four colors. In a first configuration, the strap may be folded in half to reveal two initial colors on opposing sides of the strap. The belt may display one side of the strap as a first color and may be reversed to display the opposite side of the strap as a second color. In a second configuration, the strap may be folded in half in the opposite direction to reveal two additional colors on the opposing sides of the strap. The belt may display one side of the strap as a third color and may be reversed to display the opposite side of the strap as a fourth color.

1 Claim, 2 Drawing Sheets

(56) References Cited

U.S. PATENT DOCUMENTS

| | | | | | |
|---|---|---|---|---|---|
| 4,063,313 | A * | 12/1977 | Hagios | A41F 9/002 | 2/338 |
| 4,348,774 | A * | 9/1982 | Woodson | A41F 9/002 | 128/95.1 |
| 4,406,043 | A * | 9/1983 | Friedman | A44B 11/006 | 24/182 |
| 4,685,668 | A * | 8/1987 | Newlin, Jr. | A41F 9/002 | 482/106 |
| 4,689,833 | A * | 9/1987 | Daniels | A61F 5/03 | 128/95.1 |
| 4,802,667 | A * | 2/1989 | Altner | A61F 5/028 | 482/106 |
| 5,129,104 | A * | 7/1992 | Leopoldi | A41F 9/002 | 2/322 |
| 5,586,969 | A | 12/1996 | Yewer, Jr. | | |
| 5,980,562 | A * | 11/1999 | Ouellette | A61F 5/028 | 607/108 |
| 6,233,839 | B1 * | 5/2001 | Ford | A41H 1/02 | 33/562 |
| 6,289,518 | B1 * | 9/2001 | O'Connor | A41F 9/002 | 2/311 |
| 6,339,848 | B1 * | 1/2002 | Mayhood | A41F 9/002 | 2/338 |
| D645,782 | S | 9/2011 | Nykoluk | | |
| 8,141,757 | B2 | 3/2012 | Headley | | |
| 9,149,090 | B1 * | 10/2015 | Taylor | A44B 11/006 | |
| 9,930,935 | B2 * | 4/2018 | King | A44B 11/006 | |
| D885,972 | S | 6/2020 | Tahinos | | |
| 11,096,453 | B2 | 8/2021 | Shabot et al. | | |
| 11,224,531 | B2 * | 1/2022 | Strohm | A41F 9/025 | |
| 2003/0074720 | A1 * | 4/2003 | Reed | A41F 9/002 | 2/322 |
| 2005/0217080 | A1 * | 10/2005 | Kojoori | G04B 37/1486 | 24/265 WS |
| 2009/0151132 | A1 * | 6/2009 | Rotunno, Jr. | A44B 11/22 | 24/163 K |
| 2011/0072560 | A1 * | 3/2011 | Valdez | A41F 9/002 | 24/3.1 |
| 2011/0232044 | A1 * | 9/2011 | Chen | A44B 11/001 | 24/163 K |
| 2014/0259545 | A1 * | 9/2014 | King | A44B 11/006 | 29/3 |
| 2015/0013048 | A1 * | 1/2015 | Kim | A44B 11/24 | 2/321 |
| 2015/0107002 | A1 * | 4/2015 | Wang | A41F 9/002 | 2/338 |
| 2017/0065035 | A1 * | 3/2017 | Shiao | A44B 11/22 | |
| 2018/0035763 | A1 * | 2/2018 | Kumuchian | A44B 11/22 | |
| 2019/0343674 | A1 * | 11/2019 | Hadden | A61F 5/028 | |
| 2022/0338580 | A1 * | 10/2022 | Stockinger | A41F 9/00 | |

OTHER PUBLICATIONS

Reversible Black Brown Leather Belt For ferragamo buckle 35mm width 120cm length. Product Listing [online]. Copyright © 1995-2023 eBay Inc. [retrieved on Apr. 18, 2023]. Retrieved from the Internet <URL: https://www.ebay.com/itm/315721925067?_skw=reversible+black+briwn+leather+belt+35mm+width+120cm+length&itmmeta=01JJYK48GZ5BP0QBYJ97TZYNG5&hash=item49827e41cb:gJFYAAOSwX79mwvzr&itmprp=enc:AQAJAAABEHoV3kP08IDx%2BKZ9MfhVJKnaJ7IXon972Dclucy/UkO14JJUuFfy39DzAWISINoUu8yoA6afig89mVgHLbcxXqZAaE6JNhri7Cmwz9obhB8gFG3mg%2BG8XCqnEH/I%2BcI6LqSMqztIJnKvykeM47gLcX%2B11kopbJyIp12c/WShuaoji/w5c5oZj8pA/w5zQ29xe5twuLHKboH3Ni/cYSjle121pdjYNE8zaKwp4qDTQLAjWZ7Y6rQR%2BrAFFAtUUTUDn/N5USBTHO87fA3RO%2BXd9VeV2AL7tNWKIjLsHQbMNZW4yaU9YK97R3ur20ZS/4gnbj3boHKA1uYZTMc41n/zhITRwwUKjPy14t%2BY4uheDbP%7Ctkp:Bk9SR_qJkdOXZQ.

* cited by examiner

MULTI-COLOR WAISTBELT

RELATED APPLICATIONS

None.

FIELD OF THE INVENTION

The present invention relates generally to a waistbelt and more specifically to a multi-colored waistbelt.

BACKGROUND OF THE INVENTION

The classic belt is a wardrobe staple that has stood the test of time. With its timeless design and reliable functionality, it has been a trusted accessory for generations. However, as fashion evolves and personal style becomes more diverse, the limitations of a belt that only comes in one color are becoming increasingly apparent.

One of the primary drawbacks of a single-color belt is its limited versatility. While a classic brown or black belt can be a timeless choice for certain outfits, it may not always perfectly match the wide array of colors and patterns that make up a modern wardrobe. This can result in a lack of flexibility when it comes to accessorizing and creating unique looks. Fashion-forward individuals who enjoy experimenting with different styles and expressing their personality through their clothing may find the lack of color options limiting, as it may not always complement their desired aesthetic.

Another limitation of a single-color belt is its inability to adapt to changing trends or occasions. Fashion is constantly evolving, and different seasons, events, and occasions call for varying styles and color palettes. Having only one color of belt may require multiple belts to be purchased and stored to match different outfits or occasions, resulting in added expense and clutter in the wardrobe. This can be particularly inconvenient when traveling, as it may require packing multiple belts to accommodate different looks, taking up valuable space in luggage.

Furthermore, a belt that only comes in one color may not offer much in terms of functionality beyond holding up your pants. Belts can serve as more than just a functional accessory; they can also be used to express personal style, make a statement, or serve a specific purpose. For example, belts with multiple colors or patterns can be used to add a pop of color or visual interest to an outfit, or to complement other accessories such as shoes or bags. A single-color belt may not provide these additional style options or functionality.

Accordingly, there exists a need for a means by a user may own a single belt that provides a plurality of color options. The development of the multi-color waistbelt fulfills this need in a manner that is easy and cost-effective.

SUMMARY OF THE INVENTION

To achieve the above and other objectives, the present invention provides for a four color waistbelt with a strap that has a first strap segment and a second strap segment, which are coupled by a crease. The first strap segment includes a first side and a second side, while the second strap segment includes a third side and a fourth side. The distal end of the first strap segment has multiple apertures for detachable coupling to the buckle, providing sizing options for tightening and loosening the waistbelt. The buckle has a clasp for detachably coupling the proximal end of the waistbelt to the distal end, and it includes at least one pin which engages with the apertures on the strap to secure the waistbelt. The buckle is also coupled to the strap with a twist coupling, allowing the strap to twist by 180 degrees to reverse the face of the strap that is displayed.

The first side and second side of the first strap segment may be on opposite faces of the strap, and they can have different colors, such as black, brown, tan, or maroon. Similarly, the third side and fourth side of the second strap segment may be on opposite faces of the strap, and they can have different colors as well. The strap can be folded along the crease to bring the second side adjacent to the fourth side, placing the first side and third side outside of the waistbelt, or it can be folded to bring the first side adjacent to the third side, placing the second side and fourth side outside of the waistbelt. This allows the waistbelt to be worn with different colors displayed or reversed to display a different color.

The strap may have a plurality of apertures repeated at the distal end, spaced along a line running longitudinally through the strap, providing multiple sizing options for the waistbelt. The strap can be made from various materials, such as leather, plastic, nylon, heavy cloth, or canvas, and it may have specific dimensions, such as being 3½ inches wide and ⅛ inch thick. The buckle may include a monogram with at least one pin projecting from the rear, adding a decorative element to the waistbelt.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
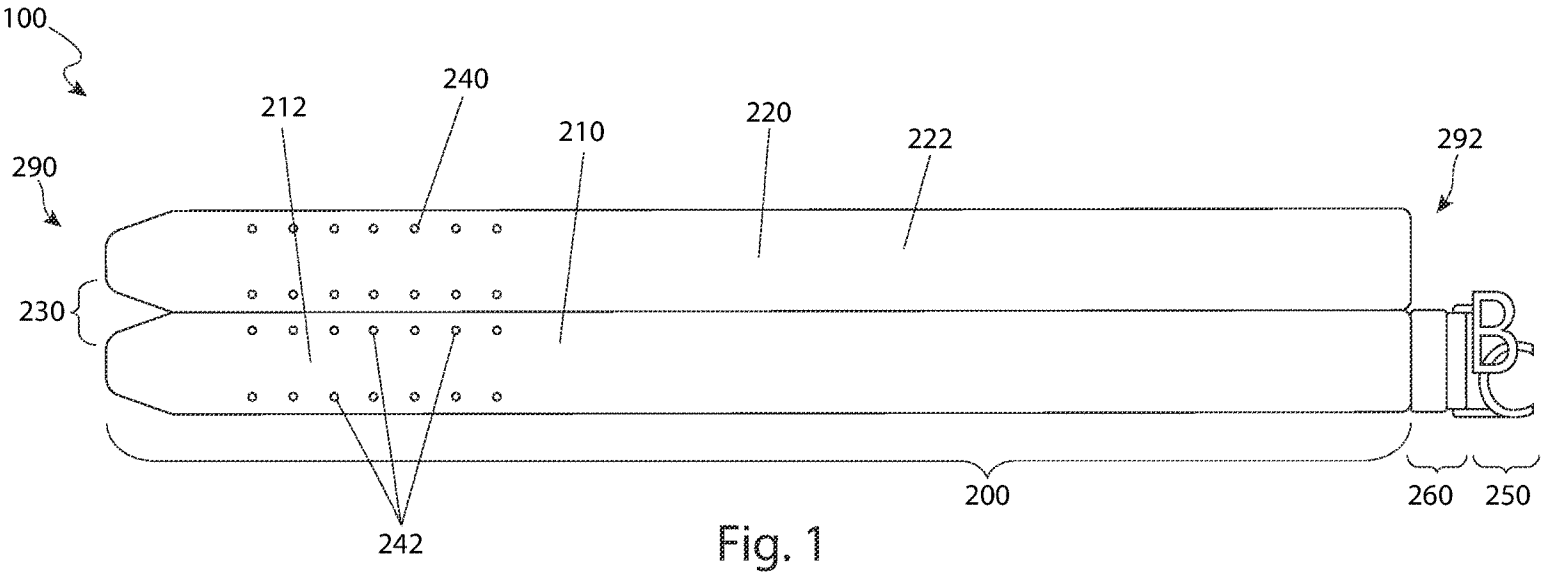
FIG. 1 is a front view of a four color waistbelt, according to an embodiment of the present invention.

100 four-color waistbelt
200 strap
210 first strap segment
212 first side
214 second side
220 second strap segment
222 third side
224 fourth side
230 crease
240 aperture
242 plurality of apertures
250 buckle
252 pin
260 twist coupling
290 distal end
292 proximal end

DESCRIPTION OF THE INVENTION

Figure 2:
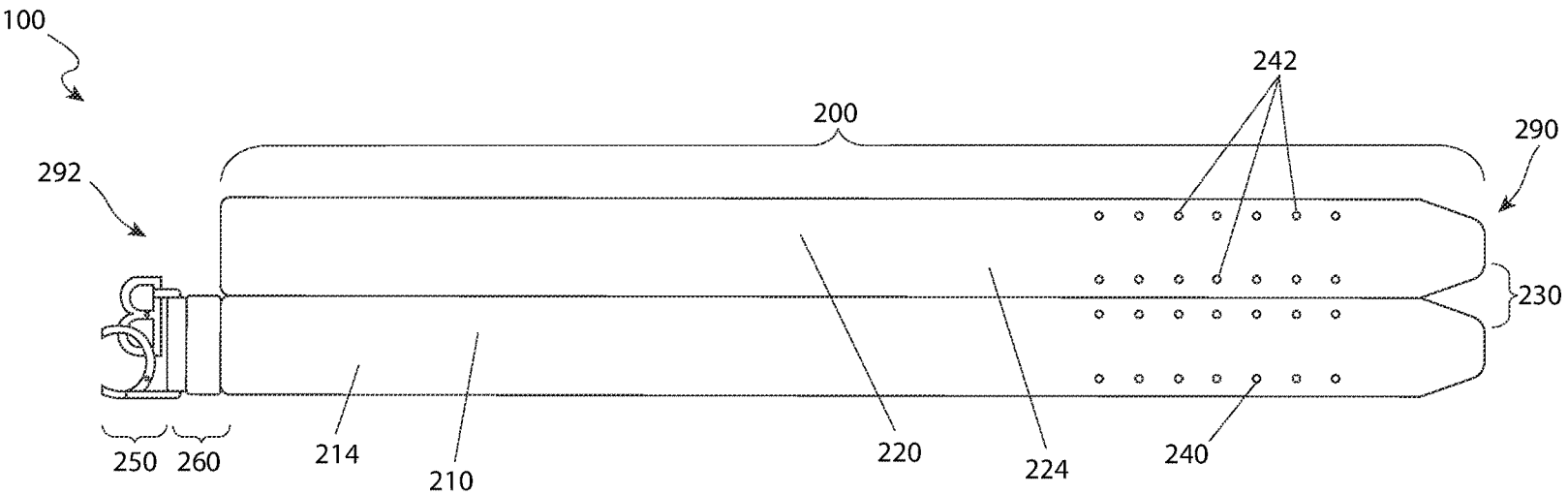
FIG. 2 is a rear view of a four color waistbelt, according to an embodiment of the present invention.
Figure 3:
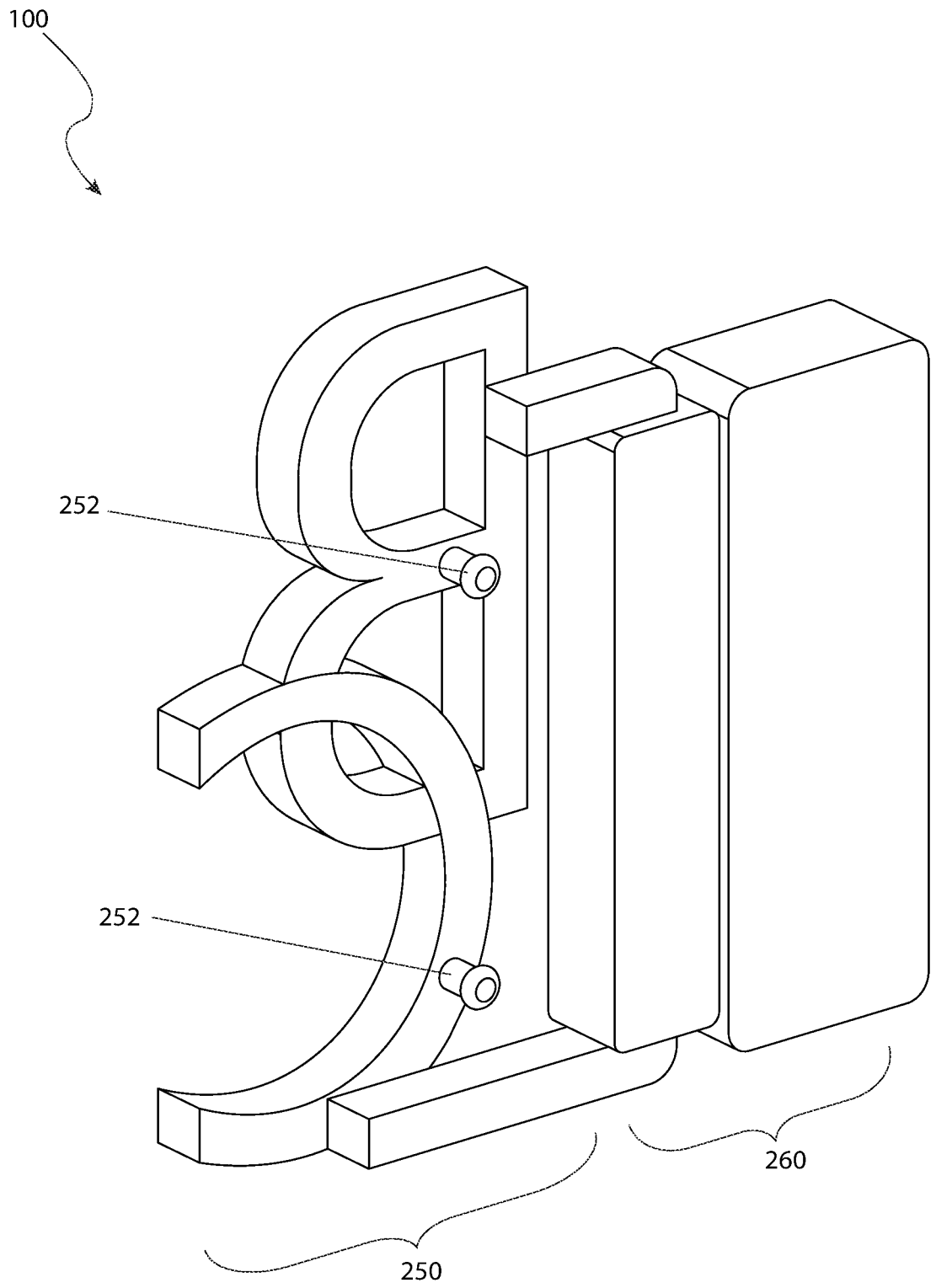
FIG. 3 is a detail view of a four color waistbelt, according to an embodiment of the present invention, illustrating the rear of the buckle and twist coupling.

FIGS. 1-3 illustrate a four color waistbelt, according to an embodiment of the present invention. The present invention is directed to a four color waistbelt (herein described as the "invention") 100. The invention 100 may comprise a strap 200, a buckle 250, and a twist coupling 260. The invention 100 may be a belt that may be reconfigured to display any one (1) of four (4) colors. In a first configuration, the strap 200 may be folded in half to reveal two (2) initial colors on opposing sides of the strap 200. The belt may display one (1) side of the strap 200 as a first color and may be reversed to display the opposite side of the strap 200 as a second color. In a second configuration, the strap 200 may be folded in half in the opposite direction to reveal two (2) additional colors on the opposing sides of the strap 200. The belt may display one (1) side of the strap 200 as a third color and may be reversed to display the opposite side of the strap 200 as a fourth color. The ability to choose one (1) of four (4) different colors may make it easier to match the belt to trousers, shoes, hats, or other garments and accessories.

The strap 200 may comprise a first strap segment 210 coupled to a second strap segment 220 by a crease 230. The first strap segment 210 and the second strap segment 220 may be identical in size and shape. As non-limiting examples, the strap 200 may be made from leather, plastic such as nylon, or heavy cloth such as canvas. In a preferred embodiment, the strap 200 may be made from leather.

The first strap segment 210 may comprise a first side 212 and a second side 214. The first side 212 and the second side 214 may be on opposite faces of the first strap segment 210. The first side 212 may comprise the first color. The second side 214 may comprise the second color.

The second strap segment 220 may comprise a third side 222 and a fourth side 224. The third side 222 and the fourth side 224 may be on opposite faces of the second strap segment 220. The third side 222 may comprise the third color. The fourth side 224 may comprise the third color.

The strap 200 may be folded along the crease 230. In the first configuration, the strap 200 may be folded along the crease 230 such that the second side 214 is brought adjacent to the fourth side 224, placing the first side 212 and the third side 222 on the outside of the belt. The belt may be adapted to be worn with the first side 212 displayed and the third side 222 against a user and the first color may be visible. The belt may be reversed to display the third side 222 and the third color may be visible.

In the second configuration, the strap 200 may be folded along the crease 230 such that the first side 212 is brought adjacent to the third side 222, placing the second side 214 and the fourth side 224 on the outside of the belt. The belt may be adapted to be worn with the second side 214 displayed and the fourth side 224 against the user and the second color may be visible. The belt may be reversed to display the fourth side 224 and the fourth color may be visible.

A distal end 290 of the first strap segment 210 may comprise at least one (1) (aperture 240 for detachably coupling to the buckle 250. At least one (1) aperture 240 may be repeated at the distal end 290 of the strap 200 such that a plurality of apertures 242 are spaced along a line running longitudinally through the strap 200. The plurality of apertures 242 may provide sizing options for tightening and loosening the belt.

In some embodiments, each position for coupling the buckle 250 may comprise a pattern of apertures. The buckle 250 may be a clasp for detachably coupling a proximal end 292 of the belt to the distal end 290 of the belt. The buckle 250 may comprise at least one (1) pin 252 which may engage at least one (1) aperture 240 in the strap 200 to secure the belt.

In some embodiments, the buckle 250 may comprise a monogram with at least one (1) pin 252 projecting from the rear of the buckle 250. The twist coupling 260 may reversibly couple the buckle 250 to the strap 200. The twist coupling 260 may permit the strap 200 to twist by one hundred eighty degrees (180°) to reverse the face of the strap 200 that is displayed.

In a preferred embodiment, the strap 200 may be three and one-half inches (3½ in.) wide. One-half inch (½ in.) may be allocated to the crease 230 while the strap 200 is folded in half, making the belt one and one-half inches (1½ in.) wide. In a preferred embodiment, the strap 200 may be one-eighth inch (⅛ in.) thick. Once folded in half, the strap 200 may result in the belt being one-quarter inch (¼ in.) thick.

In a preferred embodiment, the four colors may be black, brown, tan, and maroon. In use, the user may select a color for the belt from among the four (4) colors available and may reconfigure the belt to display the selected color. To reconfigure the belt, the user may fold the strap 200 into the first configuration or into the second configuration to reveal the first color and the third color or to reveal the second color and the fourth color. The user may then twist the twist coupling 260 to select the specific color that will be displayed when the belt is worn.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A four-color waistbelt consisting of:

a strap consisting of a first strap segment and a second strap segment coupled by a crease, wherein the first strap segment consists of a first side and a second side, and the second strap segment consists of a third side and a fourth side;

wherein each of the first side, second side, third side, and fourth side consists of a different color selected from the group consisting of black, brown, tan, and maroon; wherein the strap is foldable along the crease such that:

in a first configuration, the second side is adjacent to the fourth side, and the first side and third side are positioned outward, enabling the waistbelt to be worn with the first side displayed outward or reversed to display the third side outward; and, in a second configuration, the first side is adjacent to the third side, and the second side and fourth side are positioned outward, enabling the waistbelt to be worn with the second side displayed outward or reversed to display the fourth side outward; and, a plurality of apertures disposed at a distal end of the first strap segment for detachably coupling to a buckle;

a buckle consisting of a clasp and at least one pin, wherein the pin is configured to engage one of the plurality of apertures on the strap for adjusting the tightness of the waistbelt; and, a twist coupling reversibly coupling the buckle to the strap, wherein the twist coupling permits the strap to rotate one hundred eighty degrees (180°) to reverse the side of the strap that is displayed.

* * * * *